US006718948B2

(12) United States Patent
Vahle et al.

(10) Patent No.: US 6,718,948 B2
(45) Date of Patent: Apr. 13, 2004

(54) FUEL DELIVERY MODULE FOR PETROL DIRECT INJECTION APPLICATIONS INCLUDING SUPPLY LINE PRESSURE REGULATOR AND RETURN LINE SHUT-OFF VALVE

(75) Inventors: Stephan Vahle, Köln (DE); Thorsten Hahner, Dormagen (DE); Bernd Guntermann, Lennestadt (DE); Stan Uszko, Cologne (DE)

(73) Assignee: Visteon Global Technologies, Inc., Dearborn, MI (US)

( * ) Notice: Subject to any disclaimer, the term of this patent is extended or adjusted under 35 U.S.C. 154(b) by 144 days.

(21) Appl. No.: 10/115,183

(22) Filed: Apr. 1, 2002

(65) Prior Publication Data

US 2003/0183199 A1 Oct. 2, 2003

(51) Int. Cl.[7] ..... F02M 37/04
(52) U.S. Cl. ..... 123/458; 123/511; 123/514
(58) Field of Search ..... 123/509, 510, 123/511, 514, 458

(56) References Cited

U.S. PATENT DOCUMENTS

| | | | | |
|---|---|---|---|---|
| 4,487,188 A | | 12/1984 | Inoue et al. | |
| 4,829,966 A | | 5/1989 | D'Angelo et al. | |
| 4,883,039 A | | 11/1989 | Toshimitsu et al. | |
| 4,884,545 A | * | 12/1989 | Mathis | 123/447 |
| 4,886,026 A | | 12/1989 | Cook | |
| 5,092,301 A | | 3/1992 | Ostdiek | |
| 5,113,833 A | | 5/1992 | Nagano et al. | |
| 5,425,342 A | * | 6/1995 | Ariga et al. | 123/456 |
| RE35,195 E | | 4/1996 | Nagano et al. | |
| 5,558,068 A | | 9/1996 | Kunishima et al. | |
| 5,598,817 A | * | 2/1997 | Igarashi et al. | 123/516 |
| 5,626,114 A | * | 5/1997 | Kushida et al. | 123/198 D |
| 5,632,250 A | | 5/1997 | Kato et al. | |
| 5,727,525 A | * | 3/1998 | Tsuzuki | 123/447 |
| 6,142,120 A | * | 11/2000 | Biester et al. | 123/456 |
| 6,446,605 B1 | * | 9/2002 | Fehrmann et al. | 123/456 |

FOREIGN PATENT DOCUMENTS

| | | |
|---|---|---|
| JP | 58-135358 | 8/1983 |
| JP | 2-256868 | 10/1990 |
| JP | 8-35459 | 2/1996 |
| JP | 9-88763 | 3/1997 |
| JP | 9-177630 | 7/1997 |
| JP | 10-89176 | 4/1998 |
| JP | 2002-4965 | 1/2002 |
| WO | WO 98/55760 | 12/1998 |

* cited by examiner

*Primary Examiner*—Thomas N. Moulis
(74) *Attorney, Agent, or Firm*—Brinks Hofer Gilson & Lione

(57) ABSTRACT

A fuel delivery system and method are described that can provide different pressures of the supply of fuel to a power source such as an engine or a motor. The engine or the motor can power, for example, a vehicle or a generator. The fuel delivery system includes a fuel supply line to deliver fuel from a fuel tank to the engine or motor. A fuel pump outlet line delivers fuel from the tank to the fuel supply line. An in-tank return line returns fuel from a fuel return line to the tank. A regulator connects with the fuel pump outlet line to maintain a pressure of the fuel pump outlet line at or below a pressure set-point of the regulator. A solenoid valve connects with the in-tank return line such that a set-point pressure of the regulator is utilized when the solenoid valve closes the in-tank return line.

18 Claims, 6 Drawing Sheets

FUEL DELIVERY MODULE FOR PETROL DIRECT INJECTION APPLICATIONS INCLUDING SUPPLY LINE PRESSURE REGULATOR AND RETURN LINE SHUT-OFF VALVE

BACKGROUND

The present invention relates generally to fuel delivery systems and more specifically to a fuel delivery system that can reduce fuel vapor in direct injection applications.

Known fuel injection systems allow control over the amount of fuel entering the intake system of an engine, which improves engine efficiency and vehicle performance. Fuel injection has become standard on four-wheeled vehicles and a growing number of two-wheeled vehicles. The reasons go beyond the potential performance gains offered by fuel injection. Increasing concerns over vehicle emissions and depleted fossil fuels have made fuel injection technology a required component for vehicle manufacturers hoping to comply with clean air and other standards.

Direct injection systems are based on the concept of directly injecting fuel into the combustion chamber of the engine. Current fuel-injection technology mainly uses an injector located at the intake port of each cylinder. The injector sprays fuel into the port area while air, coming from the intake manifold of the engine, sweeps the fuel into the combustion chamber. Unlike typical fuel injection systems, a direct-injection system allows control over not just the amount of fuel entering the combustion chamber, but also when the fuel enters the combustion chamber. Direct injection can even control the shape of the fuel charge and thus create a cylinder charge having areas of pure air and areas of a combustible mixture. A benefit is an improved operating efficiency of the engine.

The direct-injected engines can suffer from reduced performance due to fuel vapor trapped in the fuel supply line to the engine. Fuel vapors in the line can occur, for example, upon start up of the vehicle. Fuel vapors can especially occur when the vehicle is started while the fuel is hot, for example, because the vehicle had previously been operating for shortly before startup. Thus, there is a need for a system and method that combine petrol engine performance with direct-injection efficiency, while maintaining low emission levels.

SUMMARY

One way to reduce fuel vapors in a fuel line is to provide a fuel system that can increase the pressure of the fuel in the fuel lines. Continuous operation at the increased pressure, however, could reduce the life of pumps located within the fuel delivery system. Thus, a system and method are disclosed for operating the fuel system at an increased pressure when needed to reduce fuel vapors, and otherwise operating the system at a lower pressure.

According to one embodiment, fuel pressure in a fuel supply line can be regulated at different pressures. The fuel supply line delivers fuel from a fuel tank to a power source, such as a combustion engine. A fuel pump outlet line delivers fuel from the reservoir to a fuel supply line. An in-tank return line returns fuel from a fuel return line to the reservoir. A regulator connects with the fuel pump outlet line to maintain a pressure of the fuel pump outlet line at or below a pressure set-point of the regulator. A solenoid valve connects with the in-tank return line such that a set-point pressure of the regulator is utilized when the solenoid valve closes the in-tank return line.

DETAILED DESCRIPTION

According to an aspect of one embodiment, a fuel delivery system and method are described that can reduce fuel vapors that could cause engine hesitation or difficulty starting the engine. One way to reduce fuel vapors is to provide a fuel delivery system that can be operated at a pressure higher than some typical fuel systems. Continuous operation at the higher pressure, however, could reduce the life of pumps located within the fuel delivery system and cause unwanted high-energy consumption of the fuel pump. Thus, a system and method are disclosed for operating the fuel system at a higher pressure at some times to reduce fuel vapors, and otherwise operating the system at a lower pressure.

Figure 1:
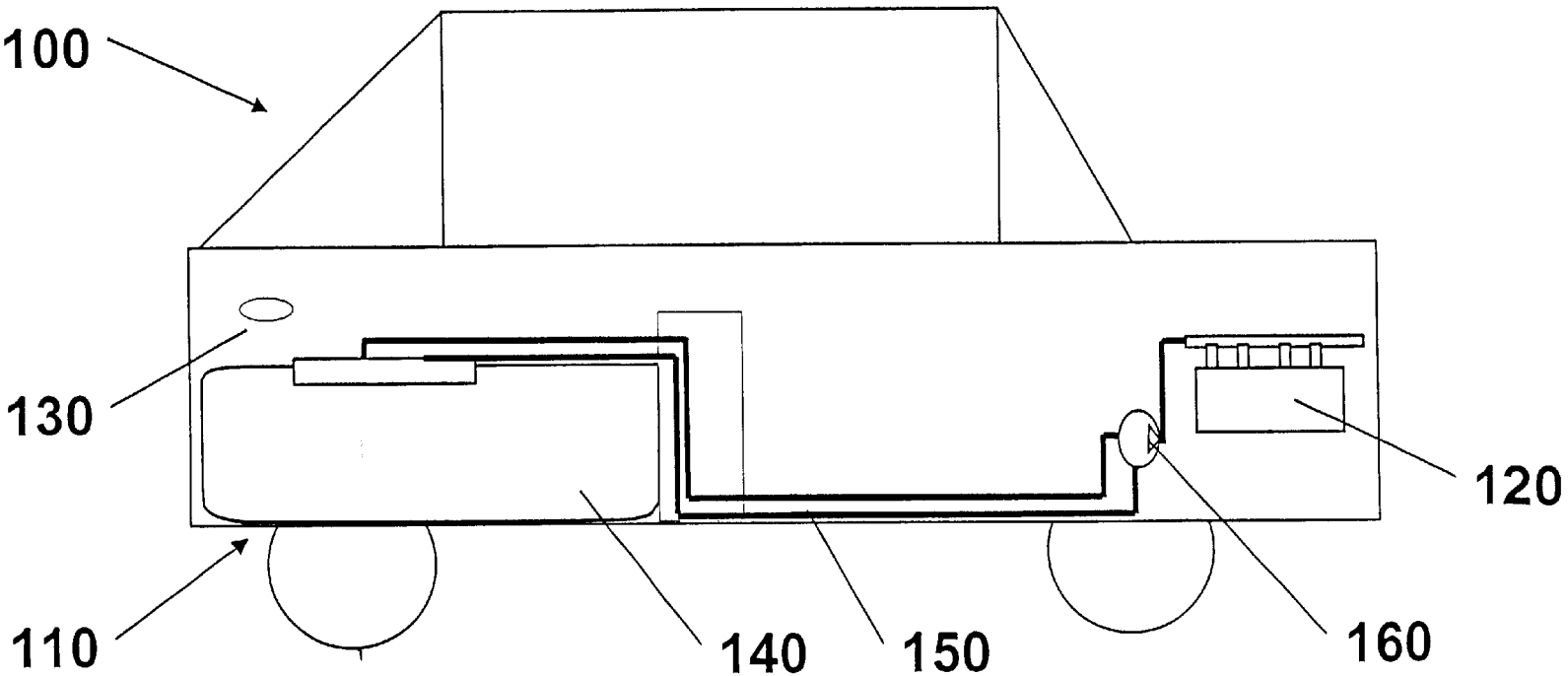
FIG. 1 illustrates a vehicle including a fuel delivery system according to one embodiment.

FIG. 1 illustrates a vehicle 100 including a fuel delivery system 110. The fuel delivery system 110 includes components that supply fuel to a power source such as a combustion engine, for example, engine 120. An exemplary engine 120 includes a 1.8 liters direct injection spark ignition engine, but other engines could be used. Exemplary fuels include petrol. Major aspects of the fuel delivery system 110 could also be used in conjunction with other fuels, such as diesel, gasoline or natural gas. The fuel delivery system 110 includes a fill-pipe 130, a fuel tank 140, fuel lines 150 and an engine pump 160. The fuel tank 140 is shown located at the rear of the vehicle 100, although on rear or mid engine vehicles, the fuel tank 140 is more typically located at the front of the vehicle 100. The vehicle 100 is shown as an automobile, but can include other vehicles that transport people and/or things, such as trucks, jeeps, sports utility vehicles, airplanes, boats and trains. The vehicle 100 could also be replaced by other devices that use fuel delivery systems, such as generators, for example, used to power buildings.

Figure 2:
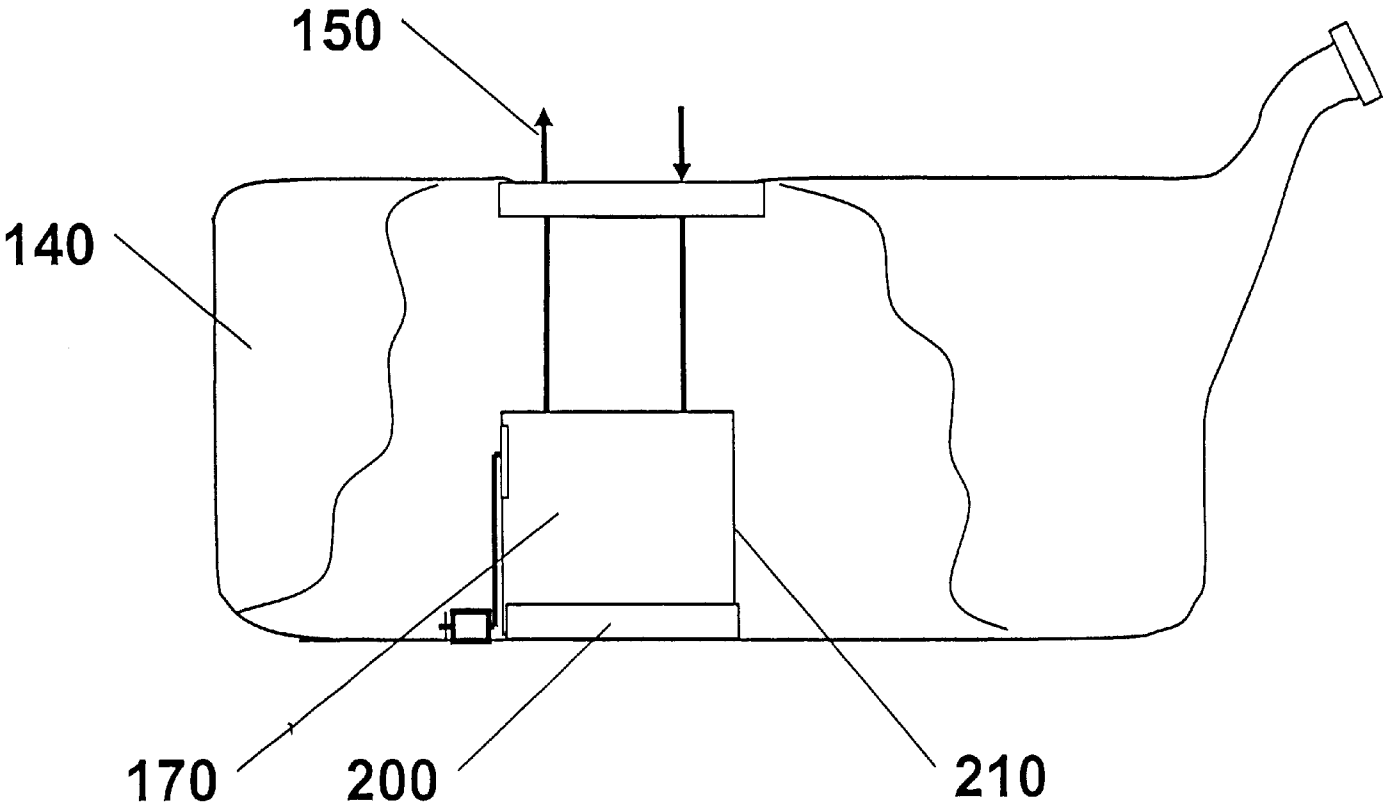
FIG. 2 illustrates a sectional view of a fuel tank of the fuel tank of the fuel delivery system of FIG. 1.

FIG. 2 illustrates a sectional view of the fuel tank 140 of FIG. 1. The fuel delivery system 110 includes a fuel delivery module 170 located within the fuel tank 140. The fuel tank 140 can be manufactured from metal or plastic, and can include a retainer ring 200 to retain the fuel delivery module 170 in place. The retainer ring 200 can be manufactured integral with the fuel tank 140 or can be attached separately to the fuel tank 140, such as by welding it to the fuel tank 140. The fuel delivery module 170 can also be retained in the fuel tank 140 in other ways, such as, by welding a housing 210 of the fuel delivery module 170 directly to the fuel tank 140. A top mounted fuel delivery module 170 could also be used that does not affix to anything but uses a spring to push up on the fuel delivery module 170 to retain a position.

Referring to FIGS. 1 and 2, fuel is supplied from the fuel tank 140 to the engine 120 via fuel lines 150. The engine pump 160 is used to increase a pressure of the fuel in the fuel lines 150 from about 4 bars to a higher pressure, for example, approximately 100 bars or other pressure required by the engine 120. The engine pump 160 pumps fuel at a rate of about 70 liters/hour.

Figure 3:
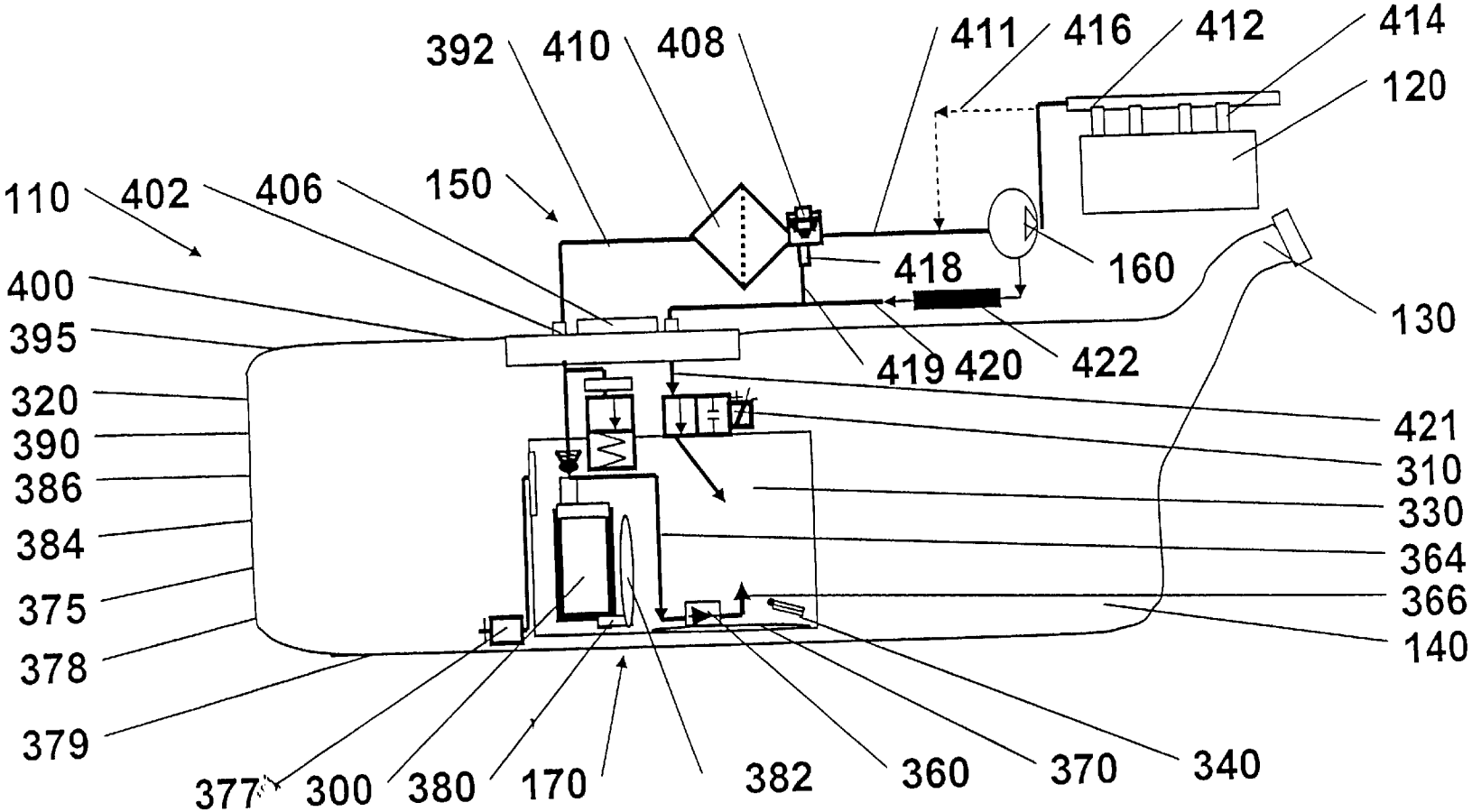
FIG. 3 illustrates an embodiment of the fuel delivery system of FIG. 1.

FIG. 3 illustrates an embodiment of the fuel delivery system 110 of FIG. 1 including the fuel delivery module 170. The fuel delivery module 170 includes a fuel pump 300, a shut-off or solenoid valve 310 and a module regulator 320. The module regulator 320 includes a pressure set-point that maintains a pressure of the fuel line to at or below the set-point pressure. The set-point pressure is set to a value higher than the normal operating pressure of the fuel delivery system 110. The solenoid valve 310 closes to increase a pressure of the fuel in the fuel lines of the fuel delivery system 110 to at least the set-point pressure of the module regulator 320. Thus, closing the solenoid valve 310 causes the module regulator 320 to regulate the fuel pressure at the set-point pressure, as described in more detail below. The solenoid valve 310 can close upon the occurrence of an event or when a determined condition occurs, as described below.

The fuel tank 140 includes a reservoir 330 that stores fuel near the fuel pump 300 to help maintain a constant flow of fuel to the engine 120. The reservoir 330 includes a flapper valve 340 that covers an opening between the reservoir 330 and the fuel tank 140. The flapper valve 340 automatically opens if a fuel pressure outside the reservoir 330 is greater that the fuel pressure inside the reservoir 330. For example, if there is fuel in the fuel tank 140, but not in the reservoir 330, the force of the fuel from the fuel tank 140 opens the flapper valve 340 to allow fuel to enter the reservoir 340. Thereafter, when there is fuel in the reservoir 330, the weight of the fuel shuts the flapper valve 340. The flapper valve 340 is typically manufactured from a rubber compound or other materials that could be used to seal the hole between the reservoir 330 and the fuel tank 140.

To fill the reservoir 330 when the vehicle 100 is being operated, the fuel delivery system 110 can also include a jet pump 360. The jet pump 360 includes a jet pump inlet line 364 that connects to an output of the fuel pump 300. Using the jet pump inlet line 364, fuel is taken from the output of the fuel pump 300 and flowed through the jet pump 360 to produce a jet stream of fuel near an opening in the reservoir 330. Depending on a system pressure, fuel can be removed from the fuel pump 300 at a rate of approximately 20 liters/hour. The opening of the reservoir 330 connects to a jet pump outlet line 366. A jet flow of fuel creates a pressure to entrain fuel from the fuel tank 140, through the jet pump outlet line 366 and into the reservoir 330, typically at a rate of 100 liters/hour. The opening at the jet pump 360, from the reservoir 330 to the fuel tank 140, varies, but can typically be about 0.5 (five/tenths) mm in diameter.

A fuel filter 370 connects between the reservoir 330 and fuel tank 140. The fuel filter 370 filters fuel entering the reservoir 330 via either the flapper valve 340 or the jet pump 360. The fuel filter 370 filters out particles that could clog the fuel lines 150 and/or fuel pumps, for example engine pump 160 and fuel pump 300, of the fuel delivery system 110. An exemplary fuel filter 370 includes a mesh or screen type filter, such as a 63 micrometers mesh size filter. The fuel filters can be connected to fuel lines either by clamps, banjo bolts, flare fittings or quick-disconnect fittings. Alternatively, as in the case of a screen type filter, the filter is typically welded in place.

The fuel delivery system 110 can also include a fuel-gauge sending unit 375. The fuel-gauge sending unit 375 connects to a wiring loom (not shown) of the vehicle 100 to deliver fuel level information to an operator of the vehicle 100. The fuel-gauge sending unit 375 includes a potentiometer or variable resistor connected with a float 377. The float 377 floats on a top surface of the fuel. The float 377 connects to a float arm 378 to move up and down as the fuel level rises or falls. The float arm 378 can be constructed of steel or other non-coercive material such as plastic, and includes a diameter to pass through an opening in the float 377. A stopper 379 is included at the end of the float arm 378 to keep the float 377 from sliding off the float arm 378.

Upon start-up of the vehicle 100, power is applied to the fuel pump 300 to begin pumping fuel from the reservoir 330 to the engine 120. The fuel pump 300 includes an inlet port 380 to receive fuel. The inlet port 380 connects to a fuel pump filter 382 to help keep particles out of the fuel pump 300. An exemplary fuel pump filter 382 includes a mesh or screen filter, such as a 70 micrometers mesh size filter. The fuel pump 300 can be mechanically or electrically driven. Two general types of electric fuel pumps include the impeller type and the bellows type. The impeller type pump uses a vane or impeller that is driven by an electric motor. The impeller pumps are often mounted in the fuel tank, though they are sometimes mounted below or beside the tank. The vanes or impeller draw the fuel in through the inlet port 380 then squeeze the fuel into a tight passage of the fuel pump 300 to pressurize the fuel. The pressurized fuel then exits through the outlet port 384.

The outlet port 384 connects with a check valve 386 that includes a piston and a spring. A check valve 386 closes to prevent the fuel from returning to the reservoir 330. Pressure from the fuel pump 300 pushes the piston up against the spring to allow fuel to flow from the to the fuel pump outlet line 390. When the fuel pump 300 is not operating, however, the spring pushes the piston down to cover the outlet port 384 and to maintain fuel in the fuel supply line 392. The fuel supply line 392, as with other fuel lines in the fuel delivery system 110, are preferably manufactured from flexible corrugated tubing or convoluted hoses that resist kinking.

The module regulator 320 connects to the fuel pump outlet line 390. A module regulator filter 395 connects between the fuel pump outlet line 390 and the module regulator 320 to remove dirt and other particles from the fuel before the fuel enters the module regulator 320. An exemplary module regulator filter 395 includes a mesh or screen type filter, such as a 105 micrometers mesh filter. The module regulator 320 operates at a specified set-point that is implementation dependent. An exemplary set-point pressure is approximately 6 bars, or 600 Kpa plus or minus 30 Kpa. The module regulator operates to maintain the fuel pressure in the fuel pump outlet line 390 to not exceed the set-point pressure by releasing fuel from the fuel pump output line 390 to the reservoir 330.

The fuel pump outlet line 390 connects to the fuel supply line 392 via a flange 400. The flange 400 seals the fuel tank 140 and includes inlet and outlet hydraulic connectors 402. The hydraulic connectors 402 connect elements located outside of the fuel tank 140 to elements located within the fuel tank 140. An exemplary flange is approximately 120 mm in diameter and exemplary hydraulic connectors 402 include pressure fittings of approximately 6–8 mm in diameter.

Figure 4:
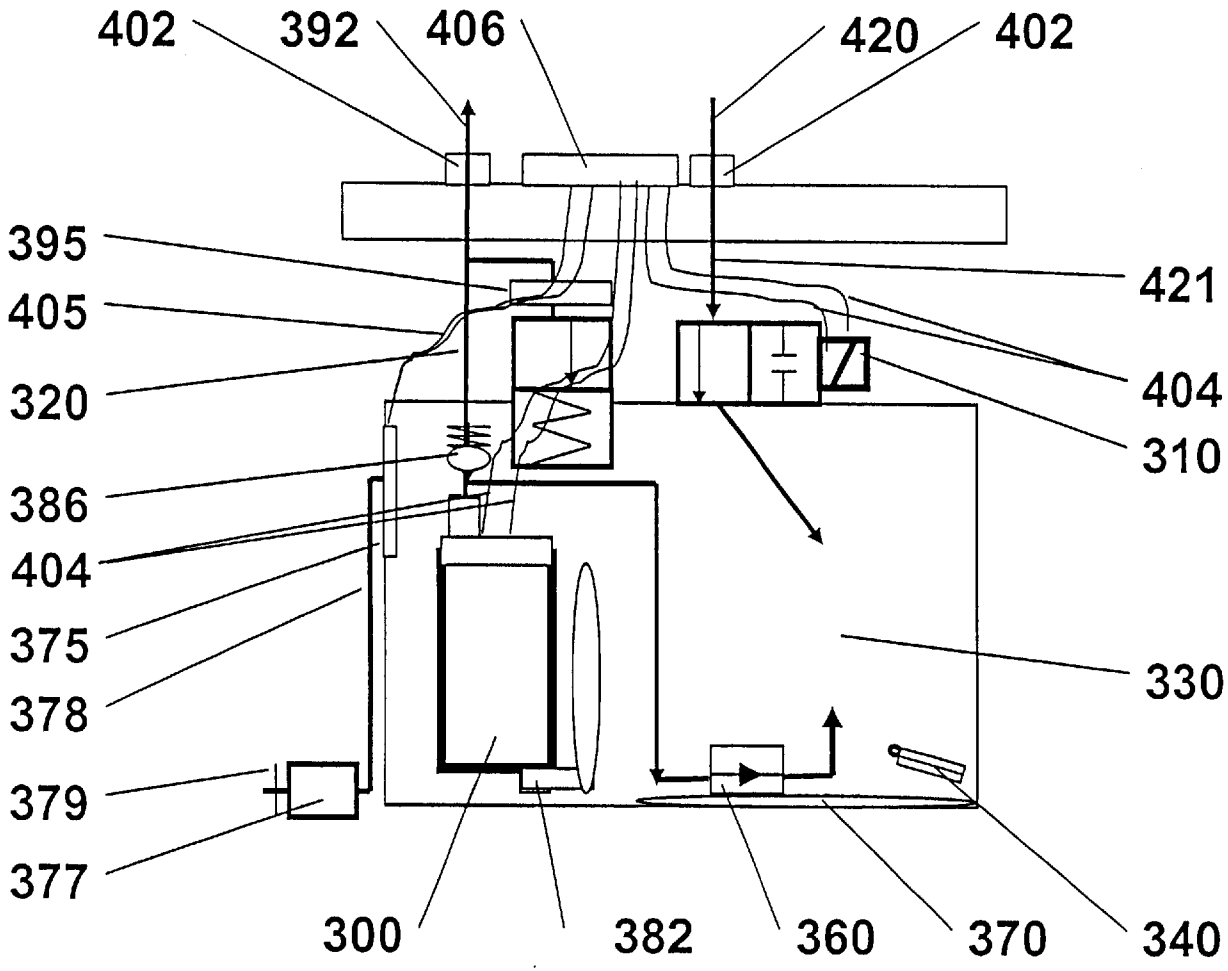
FIG. 4 illustrates an embodiment of a fuel delivery module of FIG. 3.

FIG. 4 illustrates the fuel delivery module 170, including the flange 400, in more detail. Electrical wiring 404, 405 hook up to an electrical connector 406 of the flange 400. The electrical connector 406 connects to power supplies and other wiring located in the vehicle 100. For example, electrical wiring 404 can be used to power the fuel pump 300 and the solenoid valve 310, and wiring 405 can be used to transfer signals from the fuel gauge sending unit 375 to a fuel level indicator viewed by an operator of the vehicle. The solenoid valve 310 can be mounted on the flange 400 or on top of the reservoir 330 (shown). The solenoid valve 310 can be integrally formed into the fuel delivery module 170 or can be a separate unit that is attached with straps or bolts, or in other ways, such as with clips. The solenoid valve 310 does not have to be mounted, however, it can lie in the tank 140 or hang loose. The solenoid valve 310 is constructed of a fuel resistant material such as a fuel resistant material.

Referring FIGS. 3 and 4, the fuel supply line 392 connects to a fuel system filter 410. The fuel system filter 410 removes dirt and other particles from the fuel to keep them from entering a supply line regulator 408, the engine pump 160 and the engine 120. The supply line regulator 408 operates at a determined set-point pressure, for example, approximately 4 bars. The fuel system filter 410 can be integrated with the supply line regulator 408, or can be a separate unit. Fuel flows through fuel line 411 from the supply line regulator 408 to the engine pump 160. The engine pump 160 increases a pressure of the fuel to a high pressure, such as 100 bars, and sends the fuel to an engine fuel rail 412. The engine fuel rail 412 distributes fuel to injector nozzles 414 of the engine 120. A safety return line 416 connects the engine fuel rail 412 to fuel line 411 to return excess fuel from the engine fuel rail 412.

The supply line regulator 408 includes an outlet port 418 that releases fuel via a bleed line 419 from the fuel supply line 392 to a fuel return line 420. The supply line regulator 408 operates to maintain the fuel pressure in the fuel supply line 392 to not exceed about 4 bars by releasing fuel to the fuel return line 420. The fuel return line 420 connects via the flange 400 to an in-tank return line 421. The in-tank return line 421 connects to the solenoid valve 310.

The solenoid valve 310 is normally closed, but when powered, for example with 12 volts, the solenoid valve opens to allow the flow of fuel through the fuel return line 420. When the solenoid valve 310 is closed it prevents the supply line regulator 408 from releasing fuel to the fuel return line 420. Thus, when the solenoid valve 310 is closed the pressure in the fuel supply line 392 can exceed 4 bars. In one embodiment, the solenoid valve 310 is mounted on the reservoir 330, but can also be mounted in other places such as in the tank 140 or on the flange 400.

A pump return line 422 connects to an outlet of the engine pump 160. About 15 to 20 liters/hour of fuel that enters the engine pump 160 is used to cool the engine pump 160 and returned to the fuel return line 420 via the pump return line 422. The pump return line 422 can include ribs to increase the surface area if the line which is positioned under the vehicle 100 to run to the tank 140. As the vehicle 100 moves, the air flowing past the pump return line 422 removes heat from the fuel.

Figure 5:
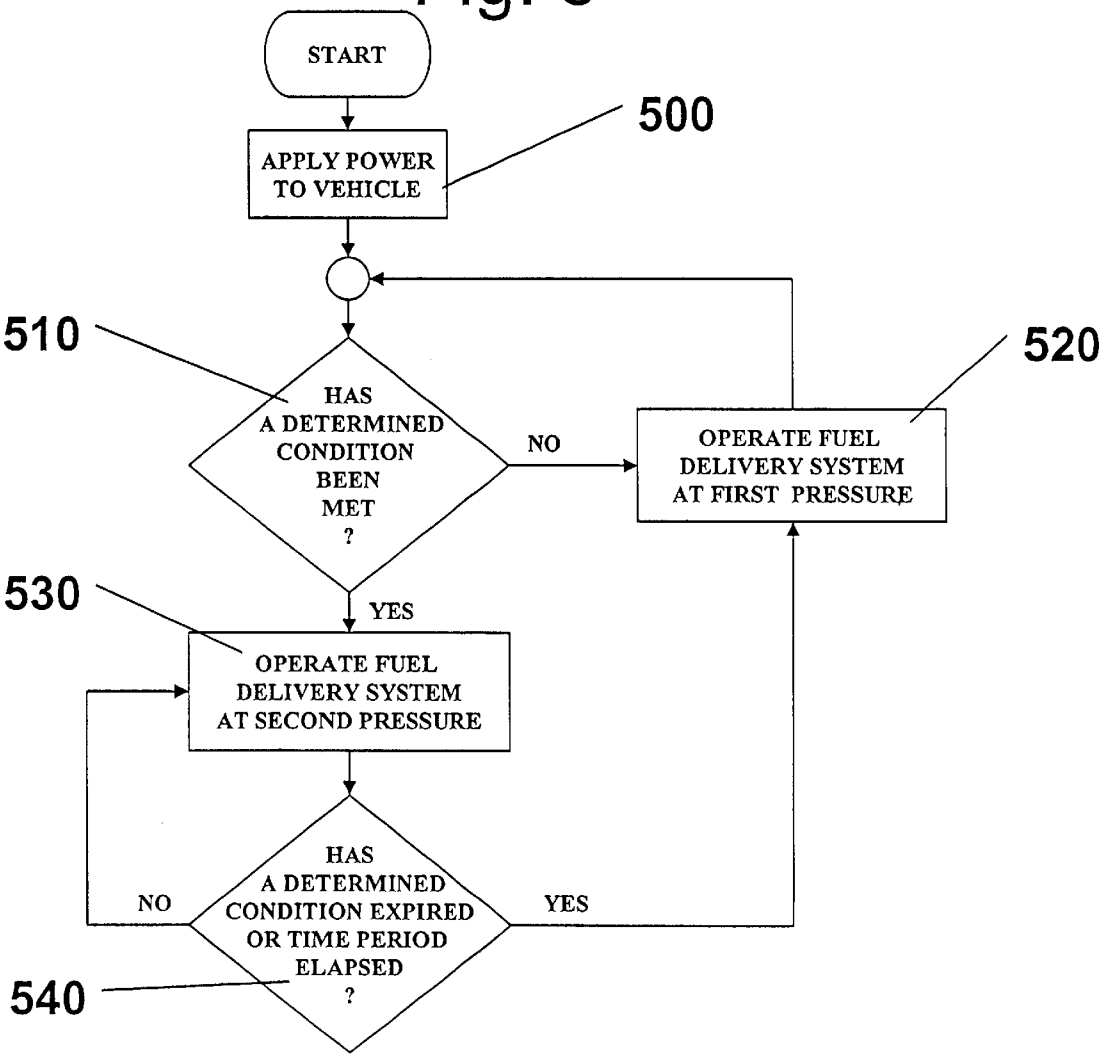
FIG. 5 is a flow chart illustrating a way to use the fuel delivery system of FIG. 1.

FIG. 5 is a flow chart illustrating a way to use the above-described fuel delivery system 110. At block 500, upon start-up of the vehicle 100 the fuel pump 300 turns on. During normal operation, for example in the 4 bars mode, the solenoid valve 310 is powered to be open and the module regulator 320 is inactive. As the vehicle 100 operates, a temperature of the fuel in the fuel delivery system 110 increases, as does the pressure in the fuel lines. As the temperature increases, fuel vapors can form. The supply line regulator 408 maintains a pressure in the fuel lines to not exceed 4 bars. Typically, the supply line regulator 408 releases about 30 to 40 liters/hour of fuel at maximum speed, and about 110 liters/hour when the engine idles.

Figure 6:
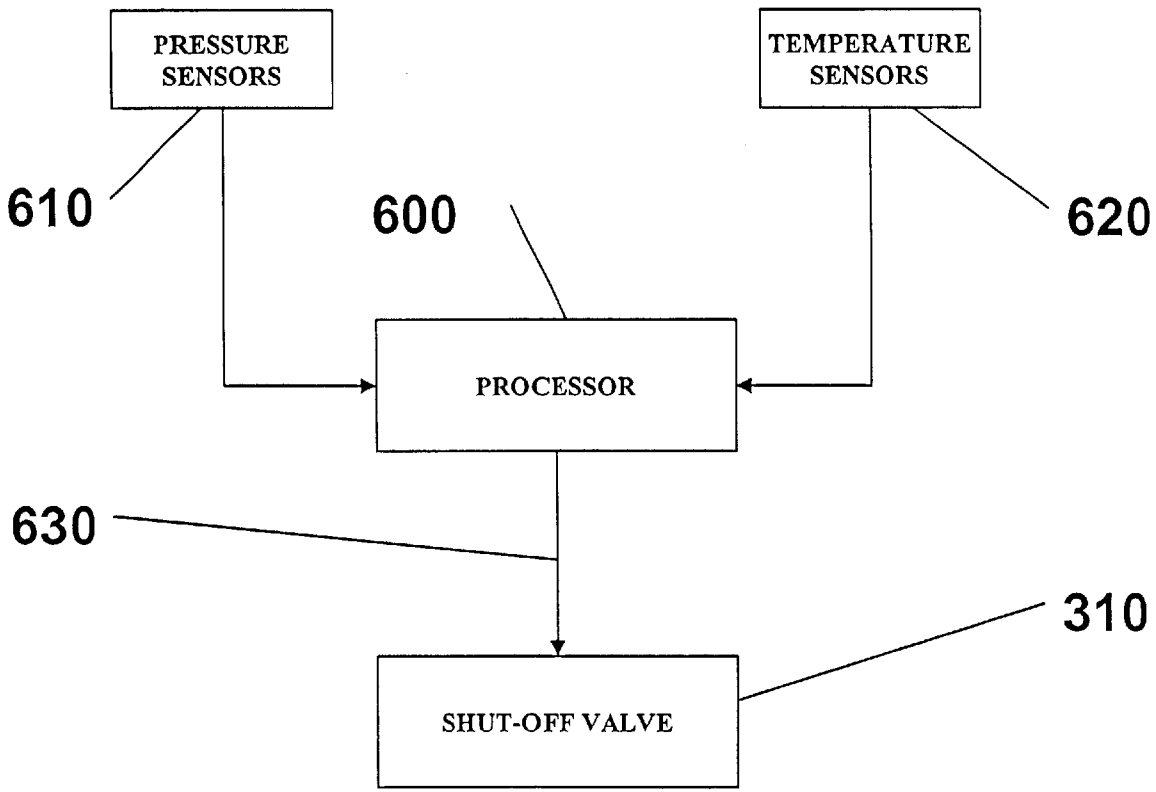
FIG. 6 illustrates an exemplary control system according to one embodiment.

Referring to FIGS. 5 and 6, at block 510 a processor 600, such as an engine control unit, determines whether any conditions have been met to switch the fuel delivery system 110 to a higher pressure. An exemplary higher pressure includes 6 bars. Condition include whether the fuel delivery system 110 is experiencing a hot operation condition or a hot start-up condition. For example, during operation of the vehicle 100, if a temperature of the engine 120 exceeds a threshold temperature, for example, 90 degrees Celsius, the fuel delivery system is switched into the high-pressure mode. The system is switched back to the regular operating mode if the temperature of the engine 120 falls below the threshold temperature or a time-out occurs, whichever occurs first. The time-out period includes a time period of about 20 to 30 seconds.

A hot start occurs, for example, after the vehicle 110 has been operating for some time, turned off, and then soon thereafter turned on again. The temperature of the engine can be measured upon start-up, as can the temperature of the fuel and the amount of time that the vehicle has been turned off. During hot start, the solenoid valve 310 remains closed and the pressure in the fuel lines increases to the set-point pressure of the module regulator 320. The solenoid valve 310 remains shut until the temperature of the fuel decreases below a threshold temperature, then the solenoid valve 310 is opened. The solenoid valve 310 may also be opened after a time-out period occurs, for example 20 to 30 seconds, the maximum time for the engine to turn on. It has been calculated that the maximum overall duration of the high-pressure mode with the solenoid valve 310 closed is about 70 hours over the lifetime of the vehicle 100. But more or less frequent usage may be provided.

The processor 600 includes software, hardware and/or firmware that can control operation of the solenoid valve 310, for example, by controlling a supply of power to the solenoid valve 310. The processor 600 can receive input signals such as from pressure sensors 610 and/or temperature sensors 620 located within the vehicle 100. The location of the pressure sensors 610 and the temperature sensors 620 is implementation dependent, and can include locations in the fuel delivery system 110, on the engine 120 or on other parts of the vehicle 100. The processor includes an output 630 to control operation of the solenoid valve 310.

When the determined condition occurs, the processor 600 disconnects or stops delivering power to the solenoid valve 310 and continues to apply voltage to the fuel pump 300. When de-energized, the solenoid valve 310 closes the in-tank return line 421 which connects to the fuel return line 420 to close the bypass of the supply line regulator 408. Since the supply line regulator 408 cannot release fuel via the bypass, the fuel pressure in the fuel delivery system 110 increases until the module regulator 320 opens. The module regulator 320 maintains a fuel pressure in the fuel delivery system 110 at or below the specified pressure of the module regulator, for example 6 bars.

At block 520, if the determined condition has not been met, power is supplied to the solenoid valve 310 to open the fuel return line 420. Thus, the fuel delivery system operates at the set-point of the supply line regulator 408, for example, 4 bars. At block 530, if the determined condition has been met, power is not supplied to the solenoid valve 310 to close the solenoid valve. It can be appreciated that a normally open solenoid valve 310 could also be used in place of the normally closed solenoid valve such that the solenoid valve 310 is closed when powered and otherwise open. In that case, power would be supplied to the solenoid valve 310 to close the solenoid valve when the determined condition occurs.

At block 540, the processor 600 determines whether the determined condition has ended or the time-out period has elapsed. If so, the solenoid valve 320 is opened to return the fuel delivery system 110 to the normal operation pressure. Otherwise, the fuel delivery system continues to operate in the high-pressure mode.

The foregoing detailed description has been provided by explanation and illustration, and is not intended to limit the scope of the appended claims. Many variations in the present embodiments illustrated herein will be obvious to one of ordinary skill in the art, and remain within the scope of the appended claims and their equivalents. For example, three or more different pressure levels could be used. Also, other or different control conditions could be used, such as a direct or indirect measurement or an estimation of fuel vapors.

We claim:

1. A fuel delivery module that supplies fuel from a reservoir located in a fuel tank to a power source such as a combustion engine, the module comprising:

a fuel pump outlet line to deliver fuel to the power source;

an in-tank return line to return fuel to the reservoir;

a regulator connected with the fuel pump outlet line; and a solenoid valve mounted on the reservoir and connected with the in-tank return line, wherein the solenoid valve is operable to activate the regulator to regulate a pressure of the fuel pump outlet line to a pressure set-point of the regulator.

2. The module of claim 1 wherein the solenoid valve operates to stop the flow of fuel through the in-tank return line.

3. The module of claim 2 wherein a pressure of the fuel pump outlet line increases when the solenoid valve is closed.

4. The module of claim 3 wherein the pressure of the fuel pump outlet line increases to the pressure set-point of the regulator when the solenoid valve is closed.

5. The module of claim 1 wherein the reservoir further comprises a flange.

6. The module of claim 5 wherein the solenoid valve is mounted on the flange of the reservoir.

7. A method for providing a determined pressure in a fuel supply line of a fuel delivery system, wherein a fuel pump outlet line provides fuel from a reservoir to a power source, and wherein the fuel delivery system further includes an in-tank return line to return fuel from a fuel return line to the reservoir, the method comprising:

providing a regulator connected with the fuel pump outlet line; and providing a solenoid valve mounted on the reservoir and connected with the in-tank return line, wherein the solenoid valve is operable to activate the regulator to control a pressure of the fuel supply line to a pressure set-point of the regulator.

8. The method of claim 7 wherein the solenoid valve operates to stop the flow of fuel through the in-tank return line.

9. The method of claim 8 wherein a pressure of the fuel pump outlet line increases when the solenoid valve is closed.

10. The method of claim 7 further including providing a flange to the reservoir.

11. The method of claim 10 wherein the solenoid valve is mounted on the flange of the reservoir.

12. A method for switching between a first pressure and a second pressure in a fuel delivery system, wherein a fuel pump outlet line of the fuel delivery system provides fuel from a reservoir to a power source, and wherein the fuel delivery system further includes an in-tank return line to return fuel from the fuel return line to the reservoir, the method comprising:

providing a solenoid valve mounted on the reservoir and connected with the in-tank return line;

providing a regulator connected with the fuel pump outlet line;

operating the solenoid valve to activate the regulator when a determined condition occurs, wherein operation of the solenoid valve and activation of the regulator causes a pressure in the fuel delivery system to switch from the first pressure to the second pressure.

13. The method of claim 12 wherein the solenoid valve operates to stop the flow of fuel through the in-tank return line.

14. The method of claim 13 wherein a pressure of the fuel supply line increases when the solenoid valve is closed.

15. The method of claim 12 further including providing a fuel pump connected with the fuel pump outlet line.

16. The method of claim 15 wherein the regulator connects with an output of the fuel pump.

17. The method of claim 12 further including opening the solenoid valve to bypass the regulator and switch a pressure of the fuel delivery system from the second pressure to the first pressure.

18. The method of claim 17 wherein opening the solenoid valve acts to deactivate the regulator.

* * * * *